US006846090B1

(12) United States Patent
Smith

(10) Patent No.: US 6,846,090 B1
(45) Date of Patent: Jan. 25, 2005

(54) BACK-LIGHTED CLIPBOARD WITH STORAGE CONTAINER

(76) Inventor: Darryl Smith, 51 Walker Pkwy., Atoka, TN (US) 38004

( * ) Notice: Subject to any disclaimer, the term of this patent is extended or adjusted under 35 U.S.C. 154(b) by 189 days.

(21) Appl. No.: 10/331,736

(22) Filed: Dec. 30, 2002

(51) Int. Cl.[7] ..... F21V 33/00
(52) U.S. Cl. ..... 362/99; 362/154
(58) Field of Search ..... 362/97, 98, 99, 362/154, 156

(56) References Cited

U.S. PATENT DOCUMENTS

| | | | | |
|---|---|---|---|---|
| 1,320,537 A | * | 11/1919 | Dimond | 362/99 |
| 3,875,396 A | * | 4/1975 | Webb | 362/99 |
| 3,977,744 A | | 8/1976 | DeWitt | |
| D255,251 S | | 6/1980 | Hansen et al. | |
| 4,892,334 A | | 1/1990 | Sinclair | |
| 5,324,076 A | | 6/1994 | Nieradka | |
| 5,381,310 A | | 1/1995 | Brotz | |
| 5,502,623 A | | 3/1996 | Brotz | |
| D379,477 S | | 5/1997 | Shamoon | |
| D446,550 S | | 8/2001 | Smith | |
| D459,397 S | | 6/2002 | Zeller et al. | |
| 6,443,588 B1 | | 9/2002 | Nunez | |

* cited by examiner

*Primary Examiner*—Stephen F Husar
(74) *Attorney, Agent, or Firm*—Lanier Ford Shaver & Payne P.C.

(57) ABSTRACT

A back-lighted clipboard having a transparent writing surface, a light assembly, and power supplies held removably in place on a document storage container by a retaining clip. The writing surface is lighted from below from the light assembly which projects light into the storage container. The clipboard can be easily assembled for use and easily disassembled for storage or repair.

11 Claims, 2 Drawing Sheets

BACK-LIGHTED CLIPBOARD WITH STORAGE CONTAINER

BACKGROUND OF INVENTION

1. Field of the Invention

This invention relates to clipboards generally and, more particularly, to a clipboard having a storage container and a transparent surface lighted from beneath.

2. Technical Background

Clipboards are well known, including those that have storage and/or lighting. Lighted clipboards are useful at night, or in poor ambient light, and storage containers are useful for holding fresh paper and completed documents. Lighted clipboards need to be lighted from above the writing surface to provide adequate light but are not practical for portable use. Lights located on the writing surface of a clipboard may not provide adequate light over the entire writing surface. An alternate approach is to provide light from beneath a transparent writing surface. Existing devices that function in this manner are relatively complex and require the lights to be imbedded in the writing surface or in an illuminated sheet.

SUMMARY OF THE INVENTION

The clipboard of the present invention has a transparent writing surface, a light assembly, and power supplies, held removably in place on an upper end of a document storage container by a retaining clip. The retaining clip can open and close for the insertion and retaining of writing material on the writing surface, or to remove the writing surface to gain access to the document storage container. The document container can hold fresh paper or completed documents and access to the container can also be from the lower end or side of the document container. Power for the light assembly can be contained within the light assembly and/or in the power supply. The transparent writing surface is lighted from below by the light assembly which projects light into the storage container. The light is reflected off the internal surfaces of the storage container to provide uniform lighting to the writing surface. The clipboard can be easily assembled for use and easily disassembled for storage or repair.

An advantage of the present invention is that it provides a removable light assembly, power source, and transparent writing surface held in place on the upper end of the document container by a clip.

Another advantage of the present invention is that light projects uniformly from beneath the writing surface.

Another advantage of the present invention is that said retaining clip also retains writing paper and documents removably on the writing surface.

Another advantage of the present invention is that the writing surface can still be illuminated even if the document container is up to two-thirds full.

Another advantage of the present invention is that it can be constructed so that access to the document container can be from the lower end, side, or top of the document container, as desired.

Another advantage of the present invention is that it is simple and inexpensive to manufacture.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
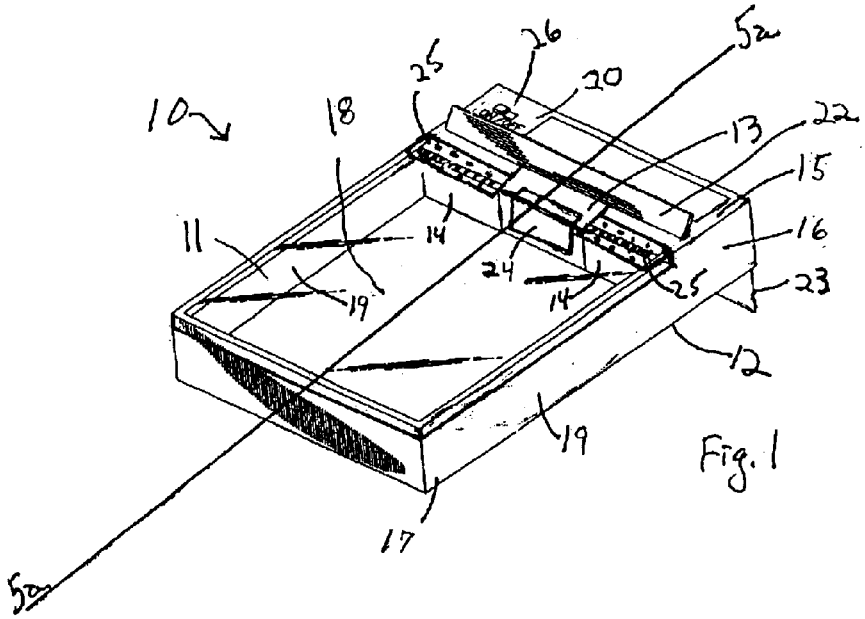
FIG. 1 shows the clipboard of the present invention.

FIG. 1 shows the clipboard 10 of the present invention. The clipboard has a transparent writing surface 11, a document container 12, a light assembly 13, one or more power supplies 14, and a retaining clip 15. Document container 12 has an upper end 16, a lower end 17, a bottom 18, and sides 19. Retaining clip 15 has a top portion 20, a bottom portion 21 (see FIG. 2), and a lip 22. Retaining clip 15 also has an optional extension 23 which serves as a stand to tilt clipboard 10 forward when resting on a desktop or similar surface. Light assembly 13 has a removable light cover 24. Writing surface 11 can extend the length of document container 12 and be held in place only by the retaining clip 15. However, in FIG. 1 writing surface 11 is shown in an alternate embodiment attached to power supplies 14 by hinges 25, which facilitate lifting writing surface 11 to gain access into document container 12. A power on/off switch 26 may be contained on a power supply 14.

Figure 2:
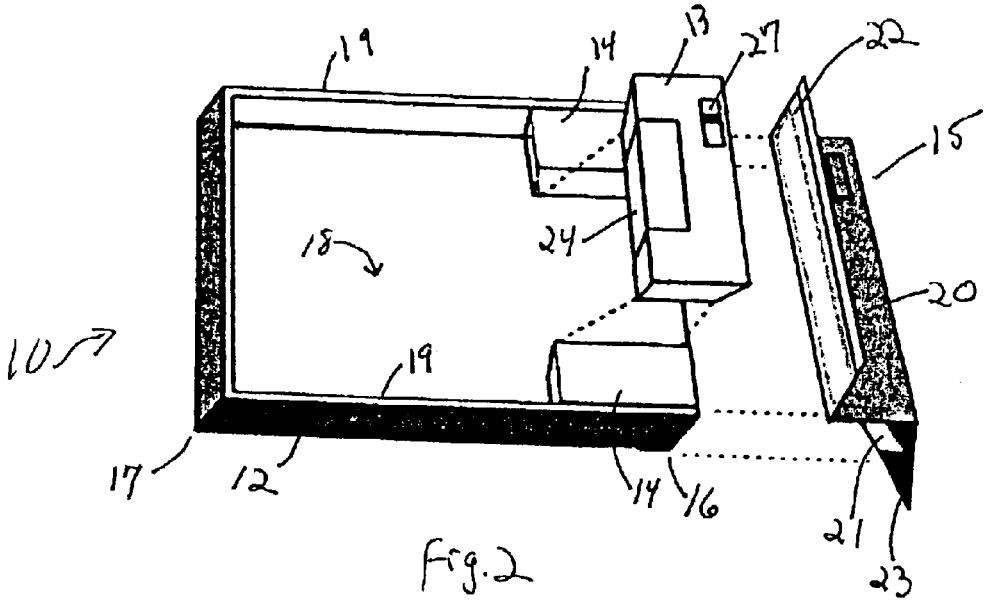
FIG. 2 shows the clipboard of the present invention disassembled.

FIG. 2 shows a disassembled view of clipboard 10, with the writing surface 11 removed. The on/off switch 26 is shown attached to light assembly 13.

Figure 3:
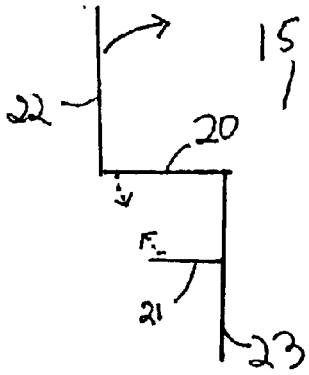
FIG. 3 shows a side view of the clip that holds the various parts of the clipboard together.

FIG. 3 shows a side view of retaining clip 15. Top portion 20 and bottom portion 21 are biased inward, as shown by the dashed arrows, to compress light assembly 13, power supplies 14, and writing surface 11 onto or within document container 12 and to hold all these items together. Lip 22 of retaining clip 15 can be pushed outward, as shown by the solid arrow, to open the clip upward in order to insert and fasten papers, documents, and the like to writing surface 11, or to remove writing surface 11.

Figure 4:
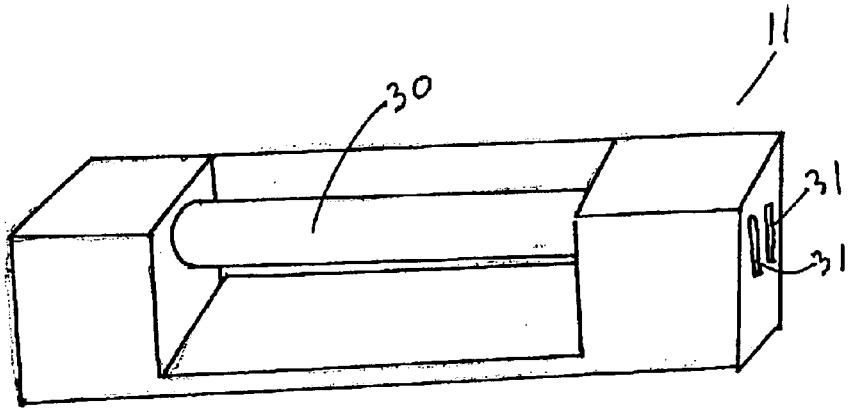
FIG. 4 shows the light assembly of the present invention.

FIG. 4 shows an illustration of light assembly 11 with cover 24 removed. Any type of replaceable light 30 known in the art may be used, preferably a fluorescent light. Power can be supplied to light assembly 13 from power supplies 14 through electrical contacts 31, or power can be supplied within light assembly 13. If power is supplied from power supplies 14, the on/off switch 26 would be located on the power supply 14 (see FIG. 1). If the power source is within light assembly 13, then the on/off switch 26 would be located on light assembly 13 (see FIG. 2). Any type of suitable batteries may be used in power supplies 14 or with light assembly 13. Also, standard AC/DC converters (adapters) may be used, as well as automobile cigarette lighter adapters, which are well known in the art.

Figure 5:
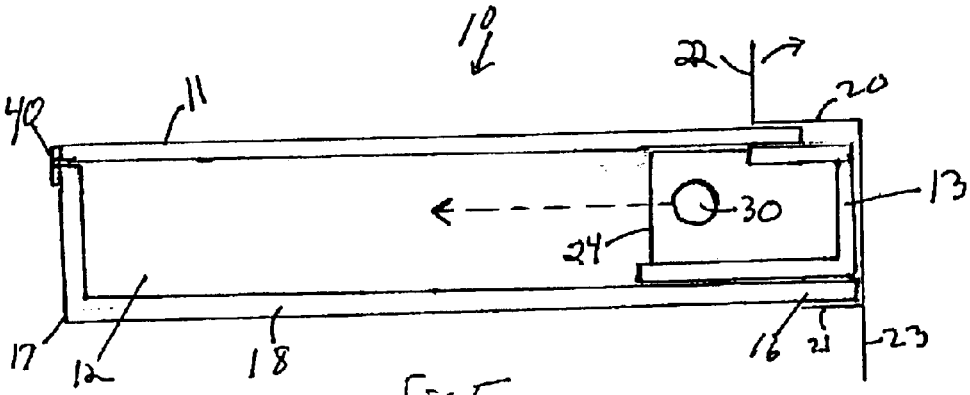
FIG. 5 shows a cross-sectional view of the clipboard of the present invention.

FIG. 5 shows a cross-sectional view of clipboard 10 along line 5*a* in FIG. 1. However, writing surface 11 is shown as hinged at lower end 17 of document container 12 by hinge 40 instead of on power supplies 14. Retaining clip 15 can be opened by pushing on lip 22 in the direction indicated by the solid arrow and raising top portion 20 above writing surface 11. Paper can then be inserted under top portion 20 and lip 22 can then be released. Top portion 22 is biased towards writing surface 11 so the paper will be held in place until the clip is opened again by pushing on lip 22.

Writing surface 11 need not be hinged to document container 12 at all because it is held in place on document container 12, light assembly 13, and power supplies 14 by the top portion 20 of retaining clip 15. However, hinge 40 may facilitate opening document container 12 from the top by lifting writing surface 11. As noted above, retaining clip 15 can be opened by pushing on lip 22 in the direction indicated by the solid arrow and raising top portion 20 above writing surface 11. This will also permit writing surface 11 to be lifted or removed from document container 12 and permit the insertion of paper, documents, or the like within document container 12.

Sufficient light is provided even if document container 12 is filled up to two-thirds. Light projects from light 30 out into document container 12, shown by the dashed arrow, and is reflected off the internal surfaces of bottom 18, sides 19, and end 17. The internal surfaces can be coated with white or reflective paint or covered with reflective materials, including mirrored surfaces. The light is, thus, reflected upward through the transparent writing surface 11. Writing surface 11 can be made of transparent plastic or glass. When a piece of paper is placed on writing surface 11 and the light is reflected up through writing surface 11, sufficient light is projected through the writing paper so that a user can write on the paper in a dark environment.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the various described elements and components of clipboard 10 can be made of any suitable materials, such as, for example, plastic, metal, wood, and the like. Incandescent light sources can be used. Power can be stored and supplied from the power supplies 14 or light source 11 or both. Rechargeable batteries can be used. The power supplies 14 can be replaced with storage containers or the power supplies 14 can be removed altogether and replaced with a larger light supply 11. The sides 19 or end 17 can have an opening for access to the internal compartment of document container 12. A plurality of lights may be contained in light assembly 11.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A back-lighted clipboard, comprising:

a) a light-transparent writing surface;

b) a light assembly having one or more lights;

c) a document container; and d) a retaining clip to reversibly hold said writing surface and said light assembly to said document container so that light projects from said light assembly into said document container and upward through said writing surface.

2. The clipboard of claim 1 further comprising one or more power supplies wherein said retaining clip also reversibly holds said power supplies to said document container.

3. The clipboard of claim 1 wherein said document container has reflective surfaces to project light uniformly upward through said writing surface.

4. The clipboard of claim 2 wherein said writing surface is attached to said power supplies with hinges.

5. The clipboard of claim 1 wherein said writing surface is attached to said document container with a hinge.

6. The clipboard of claim 1 wherein said document container has an opening for inserting and retrieving paper and documents.

7. A back-lighted clipboard, comprising:

a) a light-transparent writing surface;

b) a light assembly having one or more lights;

c) power supplies to power said light;

d) a document container; and e) a retaining clip to reversibly hold said writing surface, said light assembly, and said power supplies to said document container so that light projects from said light assembly into said document container and upwards through said writing surface.

8. The clipboard of claim 7 wherein said document container has reflective surfaces to project light uniformly upward through said writing surface.

9. The clipboard of claim 7 wherein said writing surface is attached to said power supplies with hinges.

10. The clipboard of claim 7 wherein said writing surface is attached to said document container with a hinge.

11. The clipboard of claim 7 wherein said document container has an opening for inserting and retrieving paper and documents.

* * * * *